US008490609B2

(12) United States Patent
Olsson

(10) Patent No.: US 8,490,609 B2
(45) Date of Patent: Jul. 23, 2013

(54) SYSTEM FOR ENERGY SUPPORT IN A CDI SYSTEM

(75) Inventor: Johan Olsson, Åmål (SE)

(73) Assignee: Sem Aktiebolag, Amal (SE)

( * ) Notice: Subject to any disclaimer, the term of this patent is extended or adjusted under 35 U.S.C. 154(b) by 588 days.

(21) Appl. No.: 12/865,744

(22) PCT Filed: Feb. 4, 2009

(86) PCT No.: PCT/SE2009/050112
§ 371 (c)(1),
(2), (4) Date: Aug. 12, 2010

(87) PCT Pub. No.: WO2009/099388
PCT Pub. Date: Aug. 13, 2009

(65) Prior Publication Data

US 2011/0006693 A1 Jan. 13, 2011

(30) Foreign Application Priority Data

Feb. 7, 2008 (SE) ..... 0800280

(51) Int. Cl.
*F02P 3/06* (2006.01)

(52) U.S. Cl.
USPC ..... 123/605; 123/596

(58) Field of Classification Search
USPC ..... 123/596, 600, 604, 605, 623, 476, 123/149 D
See application file for complete search history.

(56) References Cited

U.S. PATENT DOCUMENTS

| | | | | | |
|---|---|---|---|---|---|
| 3,889,651 | A | * | 6/1975 | Hudson | 123/623 |
| 4,084,567 | A | * | 4/1978 | Hachiga | 123/623 |
| 4,114,582 | A | * | 9/1978 | Rabus et al. | 123/650 |
| 4,176,644 | A | * | 12/1979 | Hellberg et al. | 123/625 |
| 4,213,436 | A | * | 7/1980 | Burson | 123/599 |
| 4,216,756 | A | * | 8/1980 | Mura | 123/597 |
| 4,385,617 | A | * | 5/1983 | Nakata et al. | 123/335 |
| 4,406,273 | A | * | 9/1983 | Yoshinaga et al. | 123/625 |
| 4,478,200 | A | * | 10/1984 | Nagashima et al. | 123/605 |
| 4,515,118 | A | * | 5/1985 | Haubner et al. | 123/406.56 |

(Continued)

FOREIGN PATENT DOCUMENTS

| | | | |
|---|---|---|---|
| EP | 0597352 | A2 | 5/1994 |
| EP | 0646723 | A1 | 4/1995 |
| EP | 0727578 | A2 | 8/1996 |
| JP | 2000-120517 | | 4/2000 |

OTHER PUBLICATIONS

Office Action issued in corresponding Japanese Patent Application No. 2010-545829 (Jan. 29, 2013).

(Continued)

*Primary Examiner* — Thomas Moulis
(74) *Attorney, Agent, or Firm* — Jeffrey S. Melcher; Manelli Selter PLLC

(57) ABSTRACT

This invention relates to a method and system for generating energy/power in a capacitive discharge ignition system, said system comprising at least one charge winding (L) which by means of a fly wheel and via a first rectifier device (D1) charges a charge capacitor (C1) connected to a primary winding (P) of an ignition voltage transformer (30) in order to provide said primary winding (P) with energy for generation of a spark via a secondary winding (S) of said transformer (30), wherein a voltage control/switching unit (10) is arranged to enable output of energy (Out21) from said primary winding (P).

16 Claims, 2 Drawing Sheets

U.S. PATENT DOCUMENTS

| | | | | |
|---|---|---|---|---|
| 4,722,311 | A * | 2/1988 | Erhard | 123/406.57 |
| 4,901,704 | A * | 2/1990 | Safranek | 123/599 |
| 4,958,608 | A * | 9/1990 | Saito et al. | 123/617 |
| 5,161,496 | A * | 11/1992 | Matsushima et al. | 123/185.3 |
| 5,215,066 | A * | 6/1993 | Narishige et al. | 123/620 |
| 5,404,859 | A * | 4/1995 | Okuda et al. | 123/598 |
| 5,513,618 | A * | 5/1996 | Rich et al. | 123/598 |
| 5,630,404 | A * | 5/1997 | Regazzi et al. | 123/406.57 |
| 5,816,221 | A * | 10/1998 | Krueger | 123/491 |
| 6,082,344 | A | 7/2000 | Ito | |
| 6,414,468 | B1 * | 7/2002 | Weber et al. | 322/46 |
| 6,557,537 | B2 | 5/2003 | Ikeda | |
| 6,735,512 | B2 * | 5/2004 | Yamazaki et al. | 701/102 |
| 6,763,815 | B2 * | 7/2004 | Gerhardt et al. | 123/609 |
| 6,779,517 | B2 * | 8/2004 | Sakakura | 123/630 |
| 6,848,437 | B2 * | 2/2005 | Naruse et al. | 123/644 |
| 6,935,323 | B2 * | 8/2005 | Waters et al. | 123/650 |
| 7,341,051 | B2 * | 3/2008 | Batchvarov | 123/606 |
| 7,404,396 | B2 * | 7/2008 | Toriyama et al. | 123/598 |
| 7,546,836 | B2 * | 6/2009 | Andersson et al. | 123/605 |
| 7,712,458 | B2 * | 5/2010 | Olsson | 123/604 |
| 2002/0078926 | A1 * | 6/2002 | Kolossow et al. | 123/406.57 |
| 2004/0084035 | A1 * | 5/2004 | Newton | 123/630 |

OTHER PUBLICATIONS

International Search Report issued May 19, 2009 and Written Opinion issued May 19, 2009 in parent PCT application.

* cited by examiner

SYSTEM FOR ENERGY SUPPORT IN A CDI SYSTEM

CROSS-REFERENCE TO RELATED APPLICATIONS

This application is a national stage entry under 35 U.S.C. 371 of International Application No. PCT/SE2009/050112, filed 4 Feb. 2009 designating the United States. This application claims foreign priority under 35 U.S.C. 119 and 365 to Swedish Patent Application No. 0800280-0, filed 7 Feb. 2008. The complete disclosure of these applications is incorporated herein by reference.

TECHNICAL FIELD

The present invention relates to a system and also a method for generating energy/power in a CDI system, said system comprising at least one charge winding which by means of a fly wheel and via a first rectifier device charges a charge capacitor connected to a primary winding of an ignition voltage transformer in order to provide said primary winding with energy for generation of a spark via a secondary winding of said transformer.

PRIOR ART

Nowadays, various types of ignition systems are known and commonly used on the market, such as capacitive or inductive solutions. Most of those ignition systems have a solution including some kind of battery support, e.g. U.S. Pat. No. 6,557,537 and U.S. Pat. No. 6,082,344, which in some applications strongly can be affected, due to environmentally causes e.g. humidity and temperature, and then have drastic consequences regarding performance and/or reliability. There are also cost, environmental and life time aspects to be considered when using a battery supported solution.

Ignition systems are known, without the use of battery support, and are also available on the market. However, known such systems all do show one or more disadvantages, seemingly due to accepting compromises regarding functionality to be able to eliminate battery support. It is known to, instead of battery support, use a separate small generator which however presents some disadvantages such as additional cost. Also other solutions are known, for instance, EP0727578, which shows an inductive ignition-system, wherein power is (instead of battery) taken from a primary winding to control ignition timing, i.e. control of the spark advance, but without providing any other functionality that might be desired. Further, the control circuit as such is rather complex and rather inflexible.

BRIEF DESCRIPTION OF THE INVENTION

The object of the present invention is to provide an improved system for generating energy/power in a CDI system, which is achieved by means of a system as defined in claim 1.

Thanks to the invention a very flexible and cost effective solution is achieved, which may bring along about the same kind of functionality as battery powered systems, but which at the same time eliminates the disadvantages related to battery supported systems. It is to be noted that the solution does not prevent usage of battery support, but as is evident provides the important technical advantage that battery support may be dispensed with.

Further advantages and aspects of the invention will be evident from the detailed description below.

DESCRIPTION OF THE FIGURES

The invention will be described in greater detail below with reference to the appended figures, in which.

DETAILED DESCRIPTION

Figure 1:
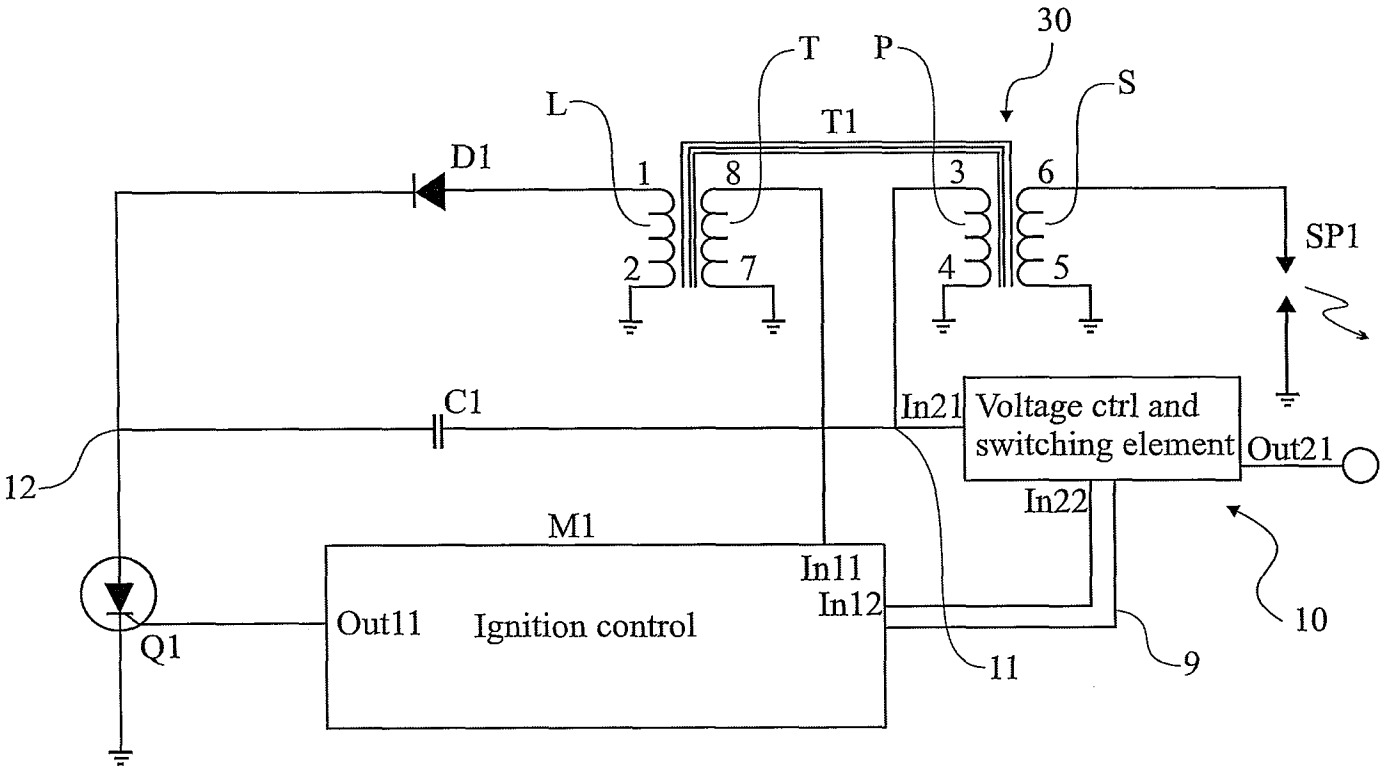
FIG. 1 shows a schematic wiring diagram presenting a voltage control/switching unit according to the invention integrated in a typical CDI system wherein several triggering alternatives are depicted.

FIG. 1 shows a schematic wiring diagram consisting of a voltage control/switching unit 10 according to the invention integrated in a somewhat simplified form of a typical CDI system.

A brief description of the typical CDI system used in this example follows. The CDI system comprises of an iron core T1 provided with four conventionally arranged windings, L, T, P and S, which are magnetised by means of one or several magnets integrated in the flywheel which at the rotation of the flywheel will sweep past the end portions of the iron core T1. The variant with several magnets could be used for providing (from a general point of view) a more powerful generator which in addition to the function as ignition voltage generator also could be used for other purposes, for example fuel injection systems or handle heating on chain saws. The relative magnet movement induces a voltage in the windings L, T, P and S according to the following.

In a so called charge winding L, there is induced a voltage which is used for the spark generation, as such. The charge winding L is via one of its end points 1 connected via rectifier devices D1 to a charge capacitor C1, in which the energy will be stored until the spark will be activated, and to a thyristor Q1. The other end point 2 of the winding L is connected to earth.

A so called trigger winding T is connected with a first end point 7 to earth and a second end point 8 to an input terminal In11 of an ignition control unit M1 and delivers to this input terminal information about the position and velocity of the flywheel and preferably also power supply to the control unit M1, e.g. to the processor thereof. It could be noted that the control unit M1 may comprise of an only slightly modified version of a known, conventional control unit.

The third winding P constitutes the primary winding and the fourth winding S the secondary winding of a transformer 30 for generating ignition voltage to a spark plug SP1. The end point 4 of the third winding P as well as the end point 5 of the fourth winding S is connected to earth.

In a conventional way an output terminal Out11 on the control unit M1 is activated when the ignition voltage should be delivered to the spark plug. The switching device (the thyristor) Q1 having a trigger electrode of which is connected to the output terminal Out11 creates a current path to earth which results in the connection of the voltage over the capacitor C1 to the primary winding P. Initially a voltage transient is then generated in the secondary winding S due to the very high voltage derivative in the connection point 12 at the anode of the thyristor Q1. Immediately thereafter the state in the transformer 30 changes into a damped self-oscillation in which the energy transits between the inductor P and the capacitor C1 through the switching device Q1.

The description above is simplified, and it is evident for the skilled person to foresee other both resonant and non-resonant circuits for spark generation without departing from the scope of the invention.

According to the invention there is a voltage control/switching unit 10, that controls output of power, at Out21, from the primary winding P which power may be used to drive a device (e.g. a sensor and/or a solenoid) externally of the ignition system. In the embodiment shown in FIG. 1 the voltage control/switching unit 10 is shown to have two input terminals In21 and In22 and one output terminal Out21. A first input terminal In22 is connected to the output terminal In12 on ignition control unit M1, and the second input terminal In21 is connected to the capacitor C1 and to the end 3 of the primary winding P via a connection point 11. The switching unit 10, is significant in that the switching (to the off mode) is only performed during a part of a complete revolution of the flywheel, and in such a way that the switching unit 10 is switched off for a desired time period (e.g. 100 μs) for not disturbing the generation of the spark. Hence, a signal to In21 or In22 or both terminals In21 and In22 together, initiates or affects the switching unit 10 to switch off during a part of a revolution of the flywheel, before or in connection with, the said control unit (M1) initiating said spark, to not negatively affect said generation of spark. The rest of the time, the unit 10 is in its "on mode", whereby an output of about 0.5-2 W is obtained at Out21, at a flywheel speed of as low as 2000 rpm.

Figure 2:
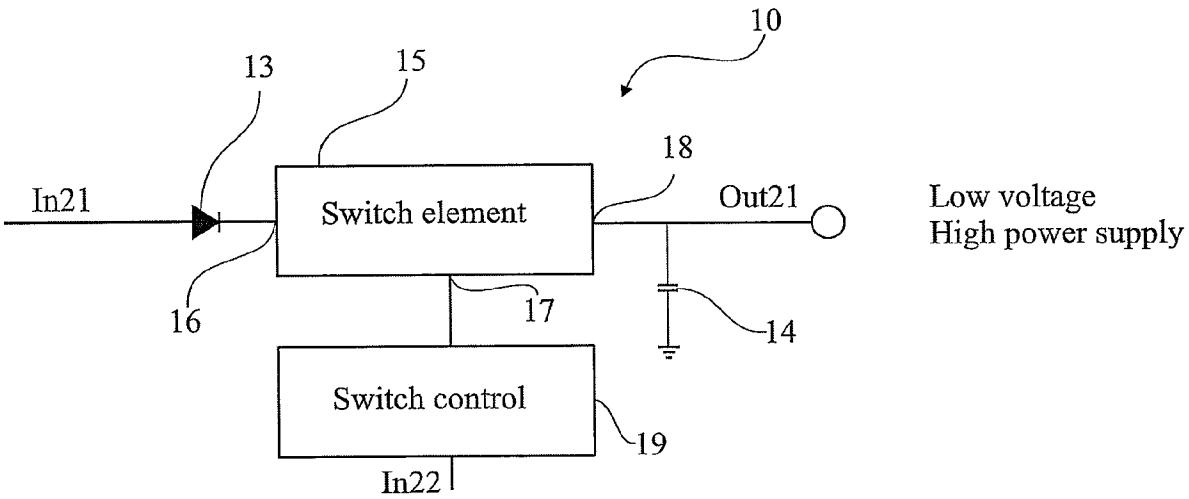
FIG. 2 shows in more detail a first alternative, depicted in FIG. 1, of an embodiment of the voltage control/switching unit according to the invention described in FIG. 1.

An optional connection 9, connecting the ignition control M1 and the voltage control/switching unit 10, enables a feedback and information about the charge/load level of a charge capacitor 14, described in FIG. 2, and the connection 9 can also be utilized for a change of the switch frequency etc. over the rpm.

The operation and method of the switching unit 10 according to the invention, and described in FIGS. 1 and 2, is such that the switching is managed/controlled by information from the in-signal on input terminals In21 and In22, either together or separately, dependent on specific needs/desires. For example if the system is set to be triggered by any in-signal and there is provided an in-signal to the input terminal In22 from the ignition control unit M1, based on information from the micro-processor therein, the switch control 19 will be controlled to switch off at a, regarding this kind of application, short period of time before the ignition control unit M1 will control the opening of the thyristor Q1, which starts the current flow through the primary winding P and generates the spark in SP1. Shortly after termination of the spark the control unit M1 will again close the thyristor Q1 and also activate the switch control 19 to be set in the on mode.

FIG. 2 shows in more detail a first embodiment of the voltage control/switching unit 10 according to the invention, that is indicated in FIG. 1, as one of the options to trigger/control the voltage control/switching unit 10. The voltage control/switching unit 10 is shown to comprise a switch control 19, a diode 13, a switch element 15 and a charge capacitor 14. The anode side of the diode 13 is connected to the input terminal In21 and the cathode side is connected to a first connector 16 of the switch element 15.

A second connector 18 of the switch element 15 is connected to the output terminal Out21 and to the charge capacitor 14.

The switch control 19, which controls the switching of the voltage control/switching unit 10, is connected to a connector 17 of the switch element 15 and to the input terminal In22. For a skilled person it is evident that the switch element 15 may comprise various components available on the market e.g. a thyristor, a Triac etc. The purpose of the switch control 19 is to control that the switch element 15 is switched off during a desired (e.g. preset in the CPU of the control unit M1) period of time, e.g. 100 μS, starting at or immediately before the generation of spark. In this embodiment the switching signals In22 are controlled by software and/or hardware and a CPU in the ignition control M1, which normally implies conventional TTL-signals, e.g. a pulse signal at In21 some μS before the initiating of the spark to put the switch element 15 in the off mode and a duration of about 100 μS to switch back to the power generating mode. A purpose of the charge capacitor 14, connected between the output terminal Out21 and earth, is to stabilize the output from terminal Out21, to provide energy to the external device when the switch element 15 is off.

Figure 3:
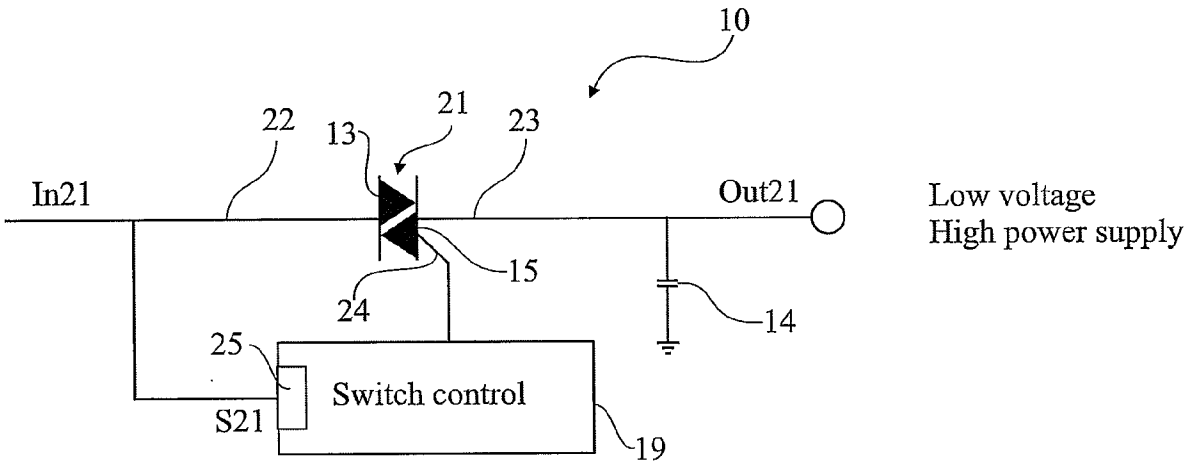
FIG. 3 shows in more detail a second alternative, depicted in FIG. 1, of an embodiment of the voltage control/switching unit according to the invention described in FIG. 1.

FIG. 3 shows in more detail a second embodiment of the switching unit 10 according to the invention, depicted in FIG. 1 as one of the options. The switching unit 10 comprises, of a Triac or thyristor or other suitable switching element 21, a spark initiation detection unit 25, the capacitor 14 and the switch control 19. Whereof one power terminal 22 of the Triac 21 is connected to the input terminal In21 (which is corresponding to the diode 13 in FIG. 2) and a second power terminal 23 is connected to the output terminal Out21. The capacitor 14, connected between the output terminal Out21 and earth, is stabilizing the outgoing voltage of the output terminal Out21, i.e. supplying power during the off mode of the control/switching unit 10. The switch control 19, which controls the switching of the switching unit 10, is connected to the gate 24 of the Triac 21 (which is corresponding to the switch element 15 in FIG. 2). The spark initiation detection unit 25, which is integrated in the switch control 19, is connected via a connection S21 to the input terminal In21 which means, according to this example, that the voltage control/switching unit 10 is connected to the CDI system via the connection In21 only.

The operation and method of the switching unit 10 shown in FIG. 3, is such that the switching is managed/controlled by information from the in-signal on the input terminal In21, which is given by the voltage transient (amplitude and/or pulse-form) in the primary winding P created when initiating the spark generation which is detected by the spark initiation detection unit 25, which in turn generates a signal to the switch control 19, whereby the switch control 19 immediately switches off the voltage control/switching unit 10. The core of the switch element in this embodiment is the Triac 21 that switches off during a certain period of time, e.g. in the range of 80-120 μS. In this embodiment the signal to switch off is not generated before the start of generation of the spark but a short time (e.g. ≦5 μS) after the start, due to the use of a detection unit 25. Accordingly the specific period of time in the off mode starts immediately after the generation of spark is initiated. When the generation of spark is ended the voltage control/switching unit 10 is switched back to the power generating mode.

It is evident that in conformity with other known spark generating CDI systems the switching may preferably be controlled by the amplitude or pulse-form of the primary winding P, wherein the signals and current flow is caused by the magnetism of the passing flywheel. Accordingly, e.g. the detection of a negative pulse on the primary winding P may be used to cause an immediate interrupt i.e. an immediate switch off of the voltage control/switching unit 10 or possibly, if desired, with a preset delayed or premature triggering. Hence, a very flexible means of controlling due to the fact that the control unit 10 may be flexibly set with a great variety of (desired) triggering parameters.

In preferred embodiments intended to be used primarily in connection with small engines (e.g. chain saws) the components of a system according to the invention may be chosen within a wide range to provide the functionality as intended by the invention. However, there are some basic requirements, e.g. that there is a charge winding L that is sufficiently powerful to generate needed energy, i.e. within the range of 1-15 mWs.

Summarized, one advantage of the switching unit 10 according to the invention is the ability to utilize the primary winding for generation of an electrical power, and this in alignment with a very low impact on the performance of the CDI system, i.e. the sparking generation, and regarding burn-time, ignition voltage, energy and the peak power. The generated energy/power can be used for supplying of internal or external units e.g. sensors, solenoids.

The invention is not limited by the embodiments described above but may be varied within the scope of the appended claims. For instance the skilled person realizes that several external units may be connected to Out21 and that for instance at a higher rpm, which produces a higher output then could be arranged for connecting a further external device, e.g. fuel mixture meter, battery charging, sensors or other small power demanding devices. Further, the skilled person realizes that many other evident modifications, may be made within the scope of protection, e.g. using a further winding (or several), in series with the primary winding, to achieve the desired voltage.

Regardless of form of embodiment, the switch unit 10 can also be used for limiting output power. This can be implemented as a voltage control device which then will regulate output voltage by switching unit 10 on/or off as a reaction to variations in both output load and engine rpm.

The invention claimed is:

1. System for generating energy/power in a capacitive discharge ignition system, said system comprising:

at least one charge winding which, by means of a fly wheel and via a first rectifier device, charges a charge capacitor connected to a primary winding of an ignition voltage transformer to provide said primary winding with energy for generation of a spark via a secondary winding of said transformer, wherein a voltage control/switching unit is arranged to enable output of energy from said primary winding, and also disrupt output of energy during a limited period of time each revolution of the flywheel.

2. System according to claim 1, wherein power is provided from said primary winding to at least one external device.

3. System according to claim 2, wherein said external device includes at least one of a CPU-unit, a solenoid, and a sensor.

4. System according to claim 2, wherein an ignition control unit controls said voltage control/switching unit.

5. System according to claim 1, wherein said system comprises no battery support.

6. System according to claim 1, wherein said voltage control/switching unit is controlled to supply said power by being activated and that in activation is controlled to be maintained merely for the duration of generated sparks.

7. System according to claim 6, wherein said voltage control/switching unit is directly controlled by means of a first signal from said ignition control unit.

8. System according to claim 6, wherein said voltage control/switching unit is indirectly controlled by means of a second signal, related to a voltage transient from the primary winding.

9. System according to claim 1, wherein said voltage control/switching unit comprises a rectifying component.

10. System according to claim 1, wherein there is a load connected to the output from said voltage control/switching unit.

11. System according to claim 10, wherein said load is a capacitor or a similar energy supplying component.

12. System according to claim 1, wherein said voltage control/switching unit comprises a rectifier diode or a Triac.

13. Method for controlling a system for generating energy/power in a capacitive discharge ignition system, said system comprising at least one charge winding which, by means of a fly wheel and via a first rectifier device, charges a charge capacitor connected to a primary winding of an ignition voltage transformer to provide said primary winding with energy for generation of a spark via a secondary winding of said transformer, wherein a voltage control/switching unit is arranged to enable output of energy from said primary winding, and also disrupt output of energy during a limited period of time each revolution of the flywheel, said method comprising:

switching of the voltage control/switching unit off during a short period of time in connection with generating a spark before either starting or initiating said spark, or shortly after.

14. Method according to claim 13, further comprising initiating the current flow through said primary winding using a thyristor, which in turn generates the spark.

15. Method according to claim 13, wherein the primary winding has a pulse and said pulse is used to deactivate said voltage control/switching unit.

16. Method according to claim 13, wherein a connection connects an ignition control unit with said voltage control/switching unit to enable feedback and information about a charge/load level of a charge capacitor in said voltage control/switching unit.

* * * * *